United States Patent [19]

Cohen

[11] Patent Number: 5,036,851

[45] Date of Patent: Aug. 6, 1991

[54] ANTIPRONATION ORTHOTIC WITH LATERAL COLUMN

[75] Inventor: Lee S. Cohen, Bryn Mawr, Pa.

[73] Assignee: Dr. Cohen Group, Inc., N.J.

[21] Appl. No.: 392,159

[22] Filed: Aug. 10, 1989

[51] Int. Cl.[5] ..... A61F 5/14

[52] U.S. Cl. ..... 128/602; 128/581; 128/586; 128/595; 128/617

[58] Field of Search ..... 128/581–586, 128/617, 590, 593, 595, 602

[56] References Cited

U.S. PATENT DOCUMENTS

| | | | |
|---|---|---|---|
| 2,109,706 | 3/1938 | Musebeck | 128/617 |
| 2,486,653 | 11/1949 | Hukill | 128/582 |
| 4,510,700 | 4/1985 | Brown | 128/595 |
| 4,603,698 | 8/1986 | Cherniak | 128/581 |
| 4,955,148 | 9/1990 | Padilla | 128/617 |

OTHER PUBLICATIONS

Letter to Editor, The Journal of American Podiatric Medical Assn.; vol. 78, No. 2, Feb. 1988, from Howard J. Dananberg.

Article, The International Journal of Sport Biomechanics, vol. 4, 1988, authored by B. M. Nigg and H. A. Bahlsen.

"The Master Shoerebuilder", James Natal, vol. XIII, No. 2, Feb. 1953.

*Primary Examiner*—Richard J. Apley
*Assistant Examiner*—Lynne A. Reichard
*Attorney, Agent, or Firm*—Leydig, Voit & Maier

[57] ABSTRACT

An antipronation orthotic employing a lateral column component having a different density and compressibility from the surrounding orthotic region for mitigating the adverse effects of podiatric anomalies, such as severe pronation, rearfoot pronation and in-toe/out-toe gait problems.

1 Claim, 2 Drawing Sheets

ANTIPRONATION ORTHOTIC WITH LATERAL COLUMN

TECHNICAL FIELD

This invention relates to variations in antipronatary orthotics incorporating a lateral column to assist in correction of adverse podiatric anomalies. More particularly, this invention relates to orthotics incorporating lateral column disposed laterally of the longitudinal bisector where the column has different compression and density characteristics from the remainder of the orthotic.

BACKGROUND OF THE INVENTION

This invention identifies and provides certain modifications to orthotic devices and enhances the elemental antipronatary orthotic described in U.S. Pat. No. 4,747,410. With reference to that antipronation orthotic, this invention includes a lateral column to supplement its antipronation effects. The addition of a lateral column, among other elements, facilitates correction of such conditions as severe pronation, rearfoot pronation and in-toe/out-toe gait problems.

The physiology of the various conditions is now described so as to facilitate a proper understanding of this invention. The conditions are presented in the following order: severe pronation, rearfoot pronation and, finally, in-toe/out-toe.

Commencing with severe pronation, reference is made to FIGS. 1–3 representing the midtarsal joint in the neutral, pronated and supinated conditions, respectively. The condition of severe pronation involves initial rearfoot eversion which causes pronation by depressing the First Metatarsal and Cuneiform below the Cuboid. Thus, the Peroneus Longus muscle is prevented from functioning properly. The improper rearfoot position adversely affects the Midtarsal Joint (the Midtarsal Joint is composed of the Calcaneal-Cuboid articulation and the Talo-Navicular articulation).

When the Subtalar Joint is neutral or supinated, the Talo-Navicular Joint is superior to the Calcaneal-Cuboid Joint (see FIGS. 1 and 3). If the Subtalar Joint is pronated, the two midtarsal joints are almost side by side (see FIG. 2). In the first case, oblique Midtarsal Joint Axis 11 is almost parallel to ground reactive force vector 13; weight bearing is thereby met with resistance from a solid, bone structure. When pronated, the two joints are adjacent, there is no bone structure to resist weight bearing and ground reactive forces 13 are sufficient to dorsiflex the forefoot on the rearfoot, thus causing skeletal imbalance and hypermobility. This is described in *Sports Medicine*, Otto Appenzeller, M.D., Ph.D., Ruth Atkinson, M.D., Urban & Schwartzenberg, Baltimore, Md. 1983, on page 406. When the Subtalar joint is neutral or supinated (FIGS. 1 and 3) the long axes 12 and 16 corresponding to the Calcaneal-Cuboid and Talo-Navicular directions of motion are oblique to each other. In this case the two joints are locked together because their directions of motion intersect, forming a solid bony structure. Contrarily, when the Subtalar Joint is pronated (FIG. 2) the directions of motion are parallel. Without intersection of the directions of motion, there is no locking of the two joints and hypermobility results.

Proceeding from the Medtarsal Joint to the forefoot, pronation causes the forefoot to turn into the ground (evert). In cases of severe pronation, continued forefoot eversion results in bunions and hammer toe conditions. Forefoot eversion results in further rearfoot eversion, thus perpetuating the pronation cycle until the rearfoot is maximally pronated.

Previous treatment of severe pronation included the use of prescription orthotics with rearfoot posting and a very high degree of forefoot varus. Such orthotics are difficult to construct accurately and fit awkwardly in a shoe.

Moving now to the physiology and kineisology of rearfoot pronation, an excellent summary is provided in *Sports Medicien*, Otto Appenzeller, M.D. Ph.D., Ruth Atkinson, M.D., Urban and Schwartzenburg, Baltimore, Md. 1983, page 408. The following was derived from that resource.

Given a normal foot (FIG. 4) the rearfoot is maximally pronated when the subtalar joint is everted 10°. The eversion of the rearfoot directly affects the stability of the First Ray (First Metatarsal and Cuneiform) and, consequently, the entire mobile adapted - rigid lever sequence of the gait cycle. When the Subtalar Joint pronates (FIG. 5), the medial arch of the foot approaches the supporting surface; that is the first metatarsal and cuneiform descend. The Peroneus Longus muscle 19, attaching to the first metatarsal at the cuneiform articulation, will accordingly descend into the transverse plane. Muscle contraction under these circumstances results in transverse vector 23 directed away from the body midline (abduction). In this case, the downward component 22 of the muscle force is reduced to the point where it is insufficient to lock the Metatarsal-Cuneiform joint into the rigid lever configuration thus hypermobilizing the first ray. Supination (inversion) of the subtalar joint allows the first Metatarsal and Cuneiform 20 to rise above the Cuboid 21. In this or the neutral condition, the peroneus longus 19 passes obliquely through the transverse plane and is able to provide the required downward component of muscle force.

Such subtalar joint pronation may be directly caused by congenital rearfoot eversion or indirectly caused by compensation for a congenital forefoot varus. In either event, it is necessary to specifically address the rearfoot condition. Previously, this has been done by rearfoot posting, that is, the application of a wedge elevated on the medial aspect to force inversion of the rearfoot. Although the technique is effective, the angle of the wedge is critical and generally difficult to achieve accurately and comfortably. Moreover, a rearfoot wedge is a static, single action component usually fabricated from hard, non-shock absorbing materials.

Turning now to the physiological aspects of in-toe/-out-toe, a frequently encountered problem, the conditions generally develop during childhood. The conditions are commonly referred to as in-toe (pigeon toed) or out-toe (crows feet). In-toe or out-toe gait results from a rotational force applied to the foot. This rotational force may be caused by anterior or posterior placement of the acetabulum (hip socket into which the femoral head fits) as well as by internal or external rotation of the femur (upper leg bone) or the Tibia (lower leg bone). Two conditions of the foot which may cause an in-toe gait are Talipes Equinovarus (clubfoot) or Metatarsas Adductus (congenital pigeon toed appearance). Some in-toe conditions may result as compensation for excess pronation but generally the reverse is true; excess pronation is compensatory for either in-toe or out-toe gaits.

In practice, the treatment for in-toe/out-toe gaits includes the use of a forefoot and rearfoot step. Using the in-toe gait as an example, a lateral step is placed on the forefoot and a medial step is placed on the rearfoot. When the forefoot encounters resistance on the lateral aspect during the propulsive phase of the gait cycle, the rearfoot is encouraged to adduct (rotate internally towards the mid-line of the body). Adduction of the rearfoot causes the forefoot to abduct, thus correcting for the in-toe gait.

The situation for the out-toe gait is exactly opposite; a step is placed on the medial aspect of the forefoot, causing the rearfoot to abduct (rotate externally away from the mid-line of the body). Consequently, the forefoot rotates internally, correcting for the out-toe gait.

In both in-toe and out-toe gait problems, previous treatment included the use of a medial rearfoot step to prevent eversion, thereby limiting pronation. However, a rearfoot step is only a static, single action component which does not embrace additional aspects of a pronating foot. Moreover, if the step is fabricated from soft materials, it breaks down rapidly and if the step is fabricated from hard materials, the angle is critical and it does not provide shock absorbing properties.

SUMMARY OF THE INVENTION

It is an object of this invention to provide an orthotic capable of use to mitigate adverse foot conditions.

It is another object of this invention to provide an orthotic structure to maximize comfort of the user while assisting to biomechanically compensate for an existing locomotion defect.

Still another object of this invention is to provide a generalized orthosis structure modifiable for particular foot conditions.

A further object of this invention is to provide an orthosis directed to mitigate severe pronation.

Another object of this invention is to provide an orthosis for minimizing severe pronation which avoids rearfoot posting or an extreme forefoot varus.

Yet another object of this invention is to provide an orthosis directed to mitigate rearfoot pronation.

Still another object of this invention is to provide a shock-absorbing orthosis directed to a rearfoot pronation condition without posting.

One further object of this invention is to provide an orthosis for assisting in correction of in-toe/out-toe gait problems.

Still another object of this invention is to provide an orthotic for producing compensating rotation of the forefoot and minimizing excess pronation without a rearfoot wedge to diminish in-toe/out-toe gait problems.

These and other objects are satisfied by a general orthosis comprising an orthotic device for mitigating the effects of adverse physiological podiatric conditions, comprising:

elongated antipronation means for minimizing foot pronation incorporating a compressible and resilient layer featuring a transverse varus wedge for underlying the metatarsal heads along the metatarsal parabola and diminishing in thickness from the medial to lateral sides, a medial shelf underlying the first ray of the foot, and a heel cup for positionally stabilizing the medial tuberosity and heel fat pad;

a column positioned laterally of the longitudinal bisector of and contained by said antipronation means, said column having a lesser density and greater compressibility than the surrounding compressible and resilient layer.

While each of the particular orthotics for the conditions described above have some different features, each shares four common elements: (1) a transverse forefoot varus wedge, (2) a medial shelf, (3) a lateral column, and (4) a heel cup.

Turning now to generalized aspects of the orthotics for the three identified conditions, the severe pronation orthosis is first reviewed.

To address the problem of severe pronation, the invention contemplates an integrated or convertible orthosis featuring a heel cup, an arch support region, a forefoot varus wedge and an extended lateral column, all fabricated from a resilient cushioning material.

The heel cup surrounds the subcalcaneal fat pad and prevents its deformation on the medial aspect. By confining the fat pad directly under the heel, the rearfoot is restrained from further eversion.

The arch support region is a medial shelf positioned directly under the First Metatarsal, beginning at the Metatarsal-Cuneiform articulation. The medial shelf prevents the first metatarsal from descending below the Cuboid during the mid-stance phase of the gait cycle thus inducing the Peroneus Longus muscle to pass obliquely through the transverse plane and provide the downward component of muscle force necessary to lock the metatarsal-cuneiform joint into the rigid lever configuration.

The forefoot varus wedge extends transversely just posterior to the metatarsal parabola, rising approximately 3° from the lateral edge to medial edge. This wedge prevents the forefoot from turning into the ground (everting).

The extended lateral column commences directly under the heel and extends the entire length of the foot to the metatarsal parabola. The lateral column is fabricated from a foam plastic that is less dense and more compressible than the material forming the medial aspect.

In reference to function, the more compressible lateral column encourages the heel to supinate, thus correcting initial rearfoot eversion. The lateral column is also positioned directly under the calcaneo-cuboid joint. In order to achieve proper interlocking of the midtarsal joint (pronated for weight bearing), the cuboid must adduct, plantarflex and invert proximal to the joint axis. Also, the talus dorsiflexes and adducts as the subtalar joint converts from the pronated to supinated positions.

In the forefoot, the lateral column underlies the forth and fifth metatarsals from the cuboid-metatarsal articulation to the metatarsal-phalangeal articulation. The greater compressibility afforded by the lateral column allows the fourth and fifth metatarsal to descend relative to the first metatarsal so that, in conjunction with the forefoot varus wedge, the lateral column potentiates the antieversion effect of the forefoot.

To accommodate these motions, the more compressible lateral column allows the cuboid to plantarflex (depress relative to the transverse plane) and invert (roll laterally) in contrast to the talo-navicular joint which is supported by the less compressible material. Accordingly, the talus and navicular are supported during dorsiflexion and abduction to remain superior to the calcaneocuboid joint, thus locking the midtarsal joint.

The lateral column, itself, may be fully integrated or comprise an interchangeable component of the orthosis. If interchangeable, substitute lateral columns composed of foam plastics of variable density and compressibility permit control by either enhancing or diminishing the function (degree of inversion) of the orthosis.

Moving now to the rearfoot pronation orthosis, it features the same four basic elements discussed above except that the lateral column is only required in the posterior (heel) region of the orthosis. The characteristics and functions of the heel cup, and support region and forefoot varus wedge are the same as those described above. One aspect of the forefoot wedge is that it minimizes forefoot eversion which, if uncorrected, will enhance rearfoot eversion and perpetuate the pronation cycle until maximum rearfoot pronation results.

The rearfoot version employs a posterior lateral column which is located directly under the heel. The column is constructed of a foam plastic that is less dense and more compressible than the material forming the medial aspect. By allowing the lateral aspect to compress more readily, the rearfoot is encouraged to supinate (invert), thus correcting for the initial eversion. As in the severe pronation version, the lateral column may be integrated or, preferably, removable and replaceable. Substitute lateral columns composed of foam plastics of variable density and compressibility allow control of the degree of supination imparted to the rearfoot without resort to the use of an accurately determined wedge.

Finally, the in-toe/out-toe gait corrective orthosis is summarized. To mitigate the problems of an in-toe or out-toe gait, the present invention employs one biomechanically significant component in addition to the heel cup, arch support forefoot varus wedge, and extended lateral column described above. That component is a forefoot torque plate. The forefoot torque plate is fabricated from relatively dense foam plastic to provide resistance, either medically or laterally to the forefoot during the propulsive state of the gait cycle. This resistance is translated into either internal or external rotation of the forefoot, depending upon the application.

The invention and its variations should become evident to the person having ordinary skill in this art upon examination of the following detailed description.

DETAILED DESCRIPTION OF THE ILLUSTRATED EMBODIMENTS

Figure 1:
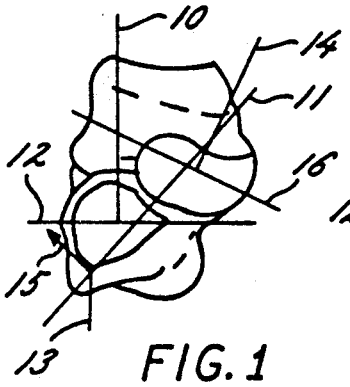
FIG. 1 represents a midtarsal joint with the subtalar joint in the neutral position.
Figure 2:
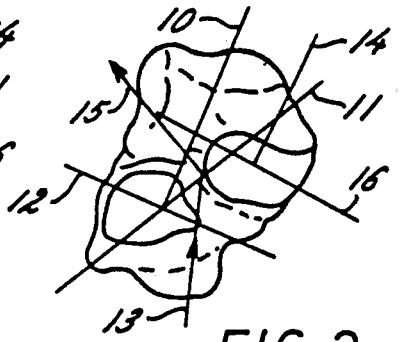
FIG. 2 represents a midtarsal joint with the subtalar joint pronated.
Figure 3:
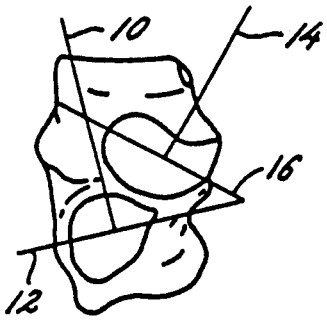
FIG. 3 represent a matatarsal joint with the subtalar joint in a supinated position.
Figure 4:
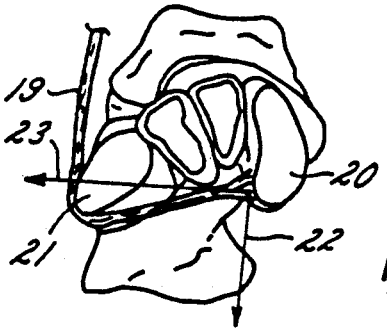
FIG. 4 represents the peroneus longus in a neutral position.
Figure 5:
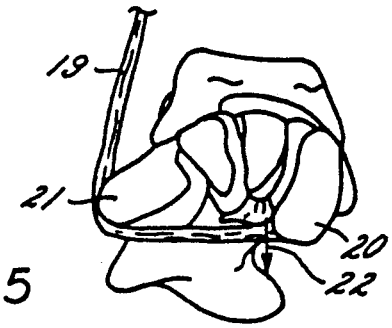
FIG. 5 represents the peroneus longus in a pronated condition.

Based on the relevancy of the content of Dr. Cohen's U.S. Pat. No. 4,747,410 issued May 31, 1988 to the instant invention, it is incorporated herein by reference.

Three of the four common biomechanical components illustrated in FIGS. 6–11 are now described.

Heel cup 42, arch support 44 (medial shelf) and forefoot varus wedge 46 are fully described in that patent. However, for purposes of this application a brief detailed description of those elements for a size 6 men's pad insert are now described.

Heel cup 42, when sectioned along its bisector, displays an overall height of 2.12 cm (27/32 in) and extends anteriorly 4.41 cm (1¾ in).

Arch support region is a medial shelf 44 which extends longitudinally 7 cm (2 13/16 in) from the posterior wall of the heel cup, and transversely 1.7 cm (11/16 in) medial to the heel cup bisector. The arch support region thickness is 0.94 cm (3/8 in) and diminishes approximately 12.6 cm (5 in) anterior to the posterior heel cup wall.

Forefoot varus wedge commences 1.4 cm (9/16 in) posterior to the metatarsal parabola and extends anteriorly approximately 4.7 cm (3/16 in). Transversely the material thickness increases from 4.31 cm (⅛ in) to 0.47 cm (3/16 in) from the lateral thereby to medial sides providing an angle rising approximately 3° from lateral to medial.

Figure 6:
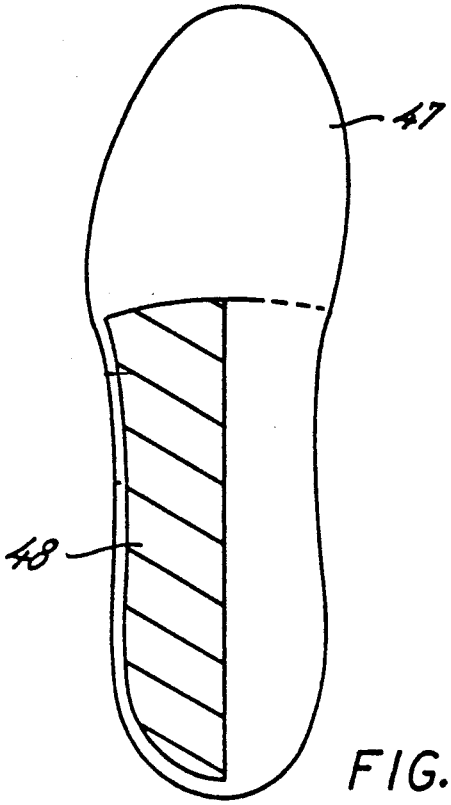
FIG. 6 is a top view schematic diagram of the severe pronation embodiment of the invention.
Figure 7:
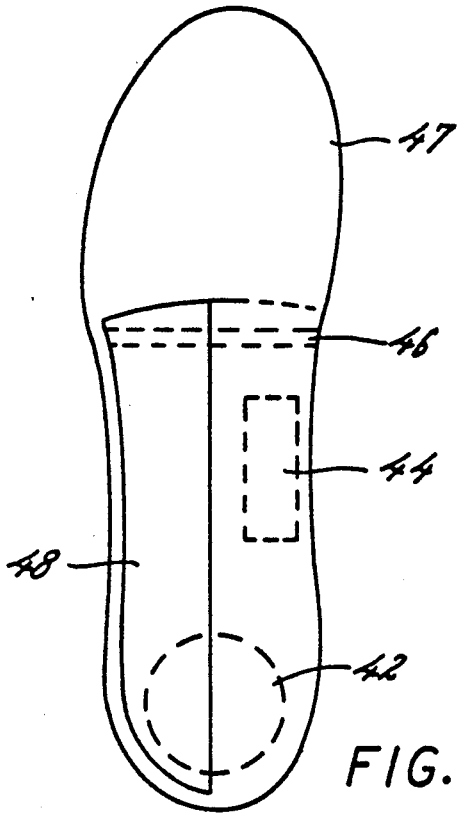
FIG. 7 is a top view schematic of the severe pronation embodiment illustrating the biomechanically active structures.

Moving now to specific features and first addressing FIGS. 6–7, the severe pronation version of the invention 47, it employs extended lateral column 48, a heel cup 42, an arch support region 44 and a forefoot varus wedge 46.

Extended lateral column 48 is positioned by commencing from the extreme posterior edge of the plantar surface (heel cup), and extending to the forefoot section where it terminates contiguous with the metatarsal parabola, a distance of approximately 15 cm (6 in) as measured from the posterior heel cup wall along the heel cup bisector. Lateral column 48 maintains thickness in accordance with the surrounding material but has a density and compressibility selected for the particular degree of biomechanical modification desired. Examples of appropriate materials and production processes are set forth below.

Figure 8:
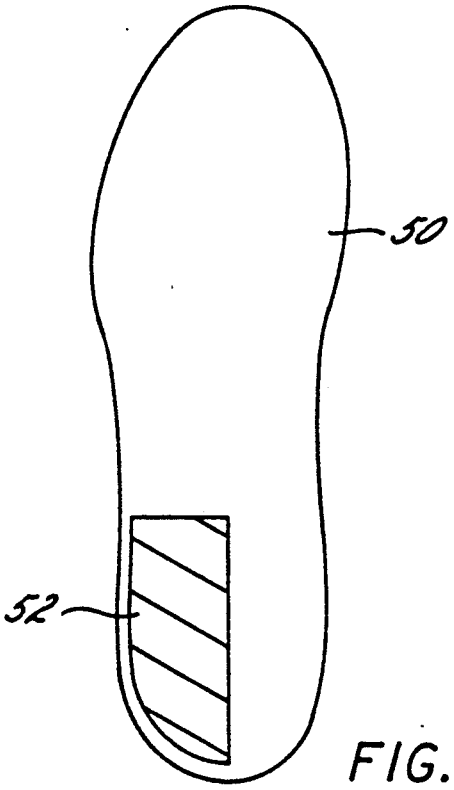
FIG. 8 is a top view schematic diagram of the rearfoot pronation embodiment of the invention.
Figure 9:
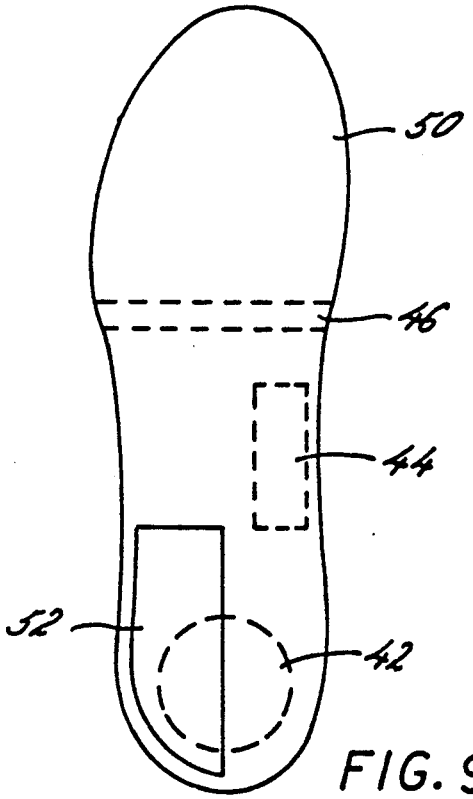
FIG. 9 is a top view schematic of the rearfoot pronation embodiment illustrating the biomechanically active structures.

Moving to rearfoot pronation insert 50 illustrated in FIGS. 8 and 9, lateral column 52 is located posteriorly. Posterior lateral column 52 extends on the lateral side of the heel cup bisector from the extreme posterior edge of the plantar surface and extends anteriorly corresponding to the underlying the region just anterior to the talo-calcaneal joint. Occupying the entire lateral plantar surface, column 52 extends 6.9 cm (2¾ in) anteriorly from the posterior heel cup wall. The thickness of column 52 conforms to that of the immediately surrounding pad region (excepting the heel cup wall).

Figure 10:
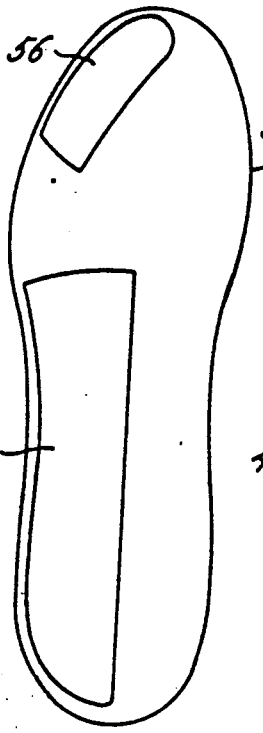
FIG. 10 is a top view schematic of the in-toe/out-toe gait correction embodiment of this invention.
Figure 11:
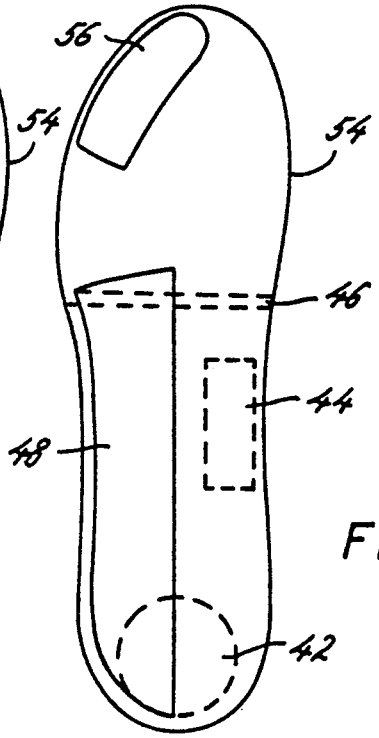
FIG. 11 is a top view schematic of the in-toe/out-toe gait correction embodiment illustrating the biomechanically active structures.

Finally, FIGS 10 and 11 illustrate in-toe/out-toe gait correction orthotic 54 which includes the same elements as the severe pronation version, i.e. heel cup 42, medial shelf 44, transverse forefoot varus wedge 46 and extended lateral column 48. The in-toe/out-toe version feature the additional element, forefoot torque place 56.

Forefoot torque plate 56 is a raised region conforming to either the lateral or medial border of the plantar forefoot. The torque plate thickness is between 0.3 cm ($\frac{1}{8}$ in) and 0.6 cm ($\frac{1}{4}$ in) depending upon the required degree of rotation intended to be imparted to the foot. The length of the midline of the torque is 6.6 cm ($2\frac{5}{8}$ in) and its maximum width is 3.10 cm ($1\frac{1}{4}$ in).

Subject to the below-described stud molding process to achieve an orthotic pad of unitary composition, a suitable material for use as the lateral column in this invention is Plastazote P078 available from United Foam Plastics, Inc. of Georgetown, Mass. That material exhibits the following densities:

0.07–0.09 g/cm$^3$ (4.4–5.5 lb/ft$^3$) before thermosetting and 0.11 g/cm$^3$ (6.4 lb/ft$^3$) thermoset to half the original thickness. Its 50% compression load deflection after thermosetting is 9.2–13.2 g/cm$^2$ (19–27 lb f/in$^2$) [ASTM 3574-81].

The preferred lateral column composition is Plastazote P2101 (having a density of 0.04 g/cm$^3$) and a 50% compression load deflection of 7.2 g/cm$^2$ (15 lb f/in). Other materials include:

Plastazote P3203:
Density: 2.1 lb/ft$^3$
50% compression load deflection: 20 lb f/in
Plastazote P4068:
Density: 2.8 lb/ft$^3$
50% compression load deflection: 24.7 lb f/in
Dow 200 LC ethafoam, density: 1.5 lb/ft
Available through Dow Chemical USA of Gales Ferry, Conn.
Dow Ethafoam 2.2 lb/ft 3 density, available through Dow Chemical USA of Gales Ferry, Conn.

In reference to the forefoot torque plate, it may be molded or cut in the desired shape and size from a sheet of suitable material such as Plastazote H9062 0.10g/cm$^3$ (6.2 lb/ft$^3$) density or Trocellen X5600 having a density of 0.10 g/cm$^3$ (6.0 lb/ft$^3$). These materials exhibit compressibility and resiliency and can either be integrated with the orthotic in production or glued onto the bottom surface of an orthotic pad insert.

Variations of the foregoing embodiments contemplated by this invention, among others, include the formation of integrated or convertible orthotics. If integrated, i.e. the particular lateral column and/or torque plate being permanently bonded to the orthotic pad, the column can be formed by independent processing and glued with a temperature and moisture insensitive, pressure-sensitive adhesive into an appropriate complementary aperture formed in the orthotic pad during molding. A unitary pad can be formed by using an appropriate stud in the mold to reduce the density of the material in the region corresponding to the lateral column. Otherwise, production of the orthotics is accomplished by following substantially the same thermoforming molding process described in the above-mentioned U.S. patent.

As another alternative, the lateral column and orthotic pad, for example, may be partially formed, the insert mold having a rib corresponding to the lateral column dimensions, then the lateral column placed in the pad which is subject to proper thermosetting to fuse the lateral column to the pad.

Should it be desireable to provide different lateral column inserts with an orthotic pad to provide either convertibility of biomechanical function or incorporation of different biomechanically active structures in the orthotic, the teachings of U.S. Pat. application Ser. No. 380,590, filed by the inventor herein on Jul. 17, 1989, for an invention entitled Biomechanical Orthosis with Convertible Inserts are applicable. Hence, the content of that application is incorporated herein by reference.

Based on the foregoing, these and other variations and modifications should now be evident to the skilled artisan and, as such, are intended to fall within the scope of the invention as defined by the following claims.

I claim:

1. An orthotic device for contact with the plantar surface of a foot, comprising:

(a) a foot cushioning pad having an outline substantially conforming to the outline of a foot, said pad being composed of a foam plastic material having a compression load deflection of 15–50 pounds per square inch, (b) an anterior extension comprising a wedge rising from the line corresponding to the metatarsal phalangeal articulation to the cuneiform metatarsal articulation, a transverse varus wedge incorporated in said anterior extension declining in thickness from the medial to the lateral border of said pad, said wedge being positioned to underlie the metatarsal heads of the foot, (c) a medial shelf incorporated longitudinally in said anterior extension, said shelf having a relatively greater thickness and compressibility than the next thicker portion of said anterior extension and being positioned to substantially underlie and support the first ray of the foot, (d) a lateral column substantially positioned laterally of the bisector of the pad and having a compression load deflection less than that of the surrounding pad, said lateral column having a density of 0.024–0.044 g/cm$^3$ (1.5–2.8 lb/ft$^3$), and (e) a heel cup extending posteriorly of said anterior extension, said heel cup defining a wall and a recessed plantar support to accommodate the calcaneus in a manner to positionally stabilize the medial tuberosity and the heel fat pad.

* * * * *